United States Patent [19]

Chemello et al.

[11] Patent Number: 4,901,450

[45] Date of Patent: Feb. 20, 1990

[54] SKI BOOT LINER

[75] Inventors: Jean-Pierre Chemello, Annecy-Le-Vieux; Thierry Perchet, Saint-Jorioz, both of France

[73] Assignee: Salomon S.A., Annecy Cedex, France

[21] Appl. No.: 239,651

[22] Filed: Sep. 2, 1988

[30] Foreign Application Priority Data

Sep. 10, 1987 [FR] France ..... 87 12789

[51] Int. Cl.[4] ..... A43B 17/00; A43B 5/04; A43B 19/00

[52] U.S. Cl. ..... 36/10; 36/4; 36/119; 12/142 P; 12/146 R; 427/322

[58] Field of Search ..... 36/10, 9 R, 117, 119, 36/71, 93, 4; 12/142 E, 142 EV, 142 P, 146 R; 427/322

[56] References Cited

U.S. PATENT DOCUMENTS

| | | | |
|---|---|---|---|
| 4,154,009 | 5/1979 | Kubelka et al. | 36/119 |
| 4,180,872 | 1/1980 | Chaikin | 36/4 X |
| 4,268,931 | 5/1981 | Salomon | 12/146 R |
| 4,385,456 | 5/1983 | Livernois et al. . | |
| 4,707,381 | 11/1887 | Ioyama et al. | 427/322 X |

FOREIGN PATENT DOCUMENTS

| | | | |
|---|---|---|---|
| 1078177 | 5/1980 | Canada | 36/4 |
| 2621396 | 11/1977 | Fed. Rep. of Germany . | |
| 3042299 | 6/1982 | Fed. Rep. of Germany | 427/322 |
| 2047650 | 3/1971 | France . | |
| 2221092 | 10/1974 | France . | |
| 2493112 | 5/1982 | France . | |
| 2549352 | 1/1985 | France . | |
| 44-19090 | 8/1969 | Japan | 36/4 |
| 6816036 | 5/1970 | Netherlands | 36/4 |

*Primary Examiner*—James Kee Chi

*Attorney, Agent, or Firm*—Sandler & Greenblum

[57] ABSTRACT

An inner boot for a ski boot which has wall portions that define the body of the inner boot. The wall portions are made from an open cell foam material. A lower portion of the inner boot includes a sealing coating of polyurethane that seals the foot of a skier against moisture and humidity. A process for manufacturing the inner boot includes degreasing the inner boot, soaking the inner boot in a polyurethane solution, removing excess polyurethane and drying the inner boot.

22 Claims, 1 Drawing Sheet

SKI BOOT LINER

BACKGROUND OF THE INVENTION

1. Field of the Invention

The present invention relates to booties or liners for alpine ski boots.

2. Description of Background and Relevant Information

Liners of ski boots are generally formed by two major methods of manufacture, namely: sewing and foam injection.

The manufacture of booties by foam injection in molds in itself constitutes significant progress with respect to the manufacture of liners by sewing, by virtue of the fact that the injection limits the costs of manual labor, manipulation, etc., and makes it possible to obtain an almost finished inner boot immediately after the last injection phase of the foam. On the other hand, the booty made by injection molding likewise makes it possible to form a technically more comfortable product because it adapts better to the anatomy of the foot in the ski boot.

Various methods of manufacturing inner boots by foam injection have formed the object of patents such as French Patent No. 22 21 092 to PALAU, French No. 20 47 650 to HUMANIC or French Patent No. 24 93 112 to SALOMON.

The material utilized to form these inner boots out of foam is generally a polyurethane foam generally having open cells. This structure having open cells however, has the disadvantage of absorbing water or humidity which, either from accidental entry of snow or even simply from the condensation of moisture on the interior of the shell of the ski boot. This disadvantage renders such inner boots relatively non-sealable to the feet of skiers.

It is to overcome this type of inconvenience that Applicants have developed a process of manufacturing taught by French Patent No. 24 93 112 in which one utilizes a inner boot made of films of polyurethane of a thickness equal to approximately 50 microns having the ability to stretch approximately a minimum of 400% which covers the exterior surface of the inner boot to which it thus provides a sealing skin situated over its entire outer periphery. However, the manufacture of such a inner boot is relatively expensive. In effect, the manufacture of this outer inner boot made of films of polyurethane is subject, on the one hand, to extensive manufacture times and positioning on the mold which requires a certain dexterity and, on the other hand, to material expenses which are substantial due to the specificity and to the characteristics of such a polyurethane film. The present invention seeks to form a inner boot for a ski boot having the same technical and sealing advantages as inner boots made of films of polyurethane while eliminating the disadvantages of manufacture and use of the latter.

SUMMARY OF THE INVENTION

The object of the present invention is to overcome the above discussed disadvantages associated with the previously known conventional ski inner boots and the processes utilized to manufacture these conventional ski inner boots.

The present invention relates more particularly to a inner boot for a ski boot characterized in that the lower portion of the inner boot which surrounds the foot of the skier is at least partially covered with a sealing coating of polyurethane.

According to a complementary characteristic of the present invention the coating of polyurethane, which comprises a thickness on the order of about 20–25 microns, is more particularly well adapted to cover a foam inner boot of injected polyurethane, and in this case to have a density which is clearly superior to that of injected polyurethane foam constituting the walls of the inner boot.

According to another advantage of the present invention it is possible to form such inner boots by industrial means which increase the cost effectiveness of the manufacture.

Finally, the present invention relates to a process for the manufacture of a inner boot for a ski boot which comprises, for example, forming an inner boot from an inner boot structure which one subjects to a sealing procedure preferably comprising applying a coating of polyurethane which covers at least a portion of the external surface of the inner boot. Of course, it is possible to apply such a coating which is likewise within the interior of the inner boot. This coating can be applied by a bath or soaking or by spraying. It has been found that the best industrial process of application for large quantities of booties to be manufactured is by the use of soaking baths.

DESCRIPTION OF PREFERRED EMBODIMENTS

The inner boot of the present invention will now be described by reference to the annexed drawings which illustrate one non-limiting example of a inner boot for a ski boot and a process of manufacture a inner boot for a ski boot according to the present invention.

Figure 1:
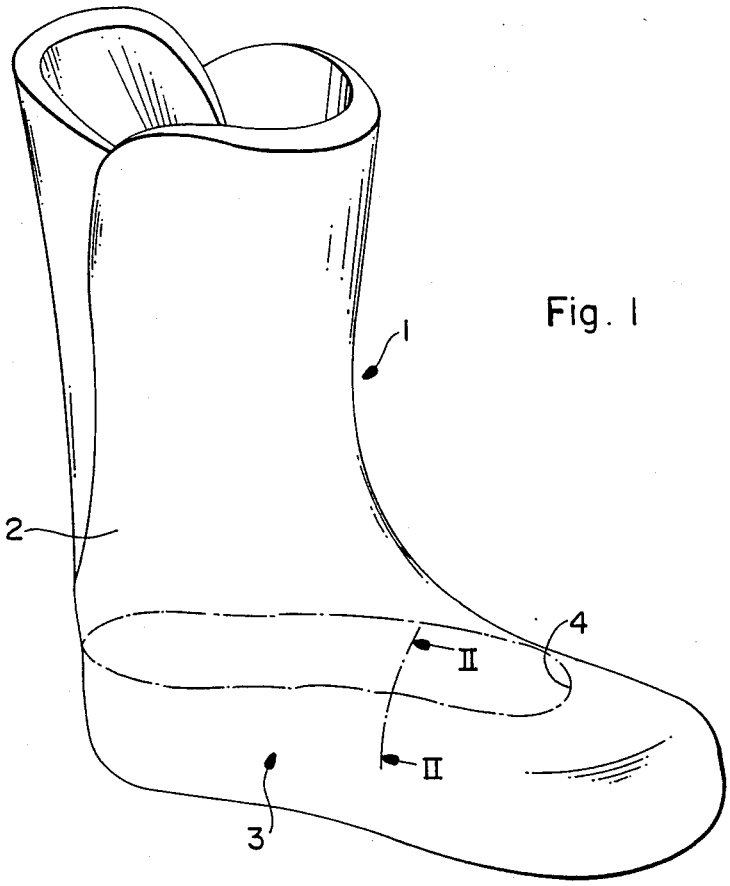
FIG. 1 illustrates a perspective view of a ski inner boot according to the present invention.

FIG. 1 illustrates a perspective view of an internal inner boot 1 of a ski boot obtained by injection of polyurethane foam in a mold. Walls 2 of the inner boot comprise a single element which forms the entire body of the inner boot. So as to seal walls 2 of the inner boot, which are made of polyurethane foam having open cells, or depending on the nature of the products utilized, having partially linked cells, the walls are covered at least in the zone 3, corresponding to the lower foot, by a coating of polyurethane 4. This coating of polyurethane gives a shiny appearance to the exterior surface of the inner boot which it covers and assures the sealing of the inner body both with respect to the open cells and with respect to the stitches or molding joints which the inner boot may contain.

Of course all of the inner boot can be covered with this coating of polyurethane without going beyond the scope of the invention. Additionally, whereas the above discussion is directed to polyurethane coatings on foam injection inner boots, the polyurethane coating of the present invention may likewise be applied to inner boots of the stitched or sewn type. This is particularly true when the materials of the walls of the inner boots are compatible with the mechanical affixative characteristics of the polyurethane coating.

Figure 2:
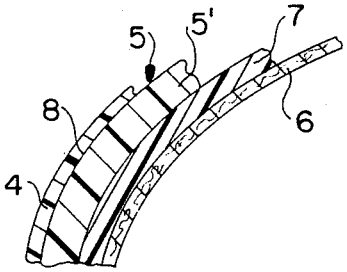
FIG. 2 illustrates a magnified cross-section of a portion of the wall of a ski inner boot according to the present invention.

FIG. 2 illustrates a magnified cross-section of a portion of the wall of the inner boot of FIG. 1 showing the affixation of the polyurethane coating layer on the foam surface of this type of inner boot. In FIG. 2, the wall 2 of the inner boot is made from a bi-component, internal coating 6 of jersey material coated with polyethylene foam 7, which in turn is coated with a layer of polyurethane foam 5 whose open cells 8, located on the external surface 5', constitute the mechanical affixation means of coating 4 on the exterior surface of wall 5'.

One of the preferred processes contemplated by the present invention relates more particularly to the sealing compositions utilized in certain soaking processes which the booties are manufactured. In this process booties formed of polyurethane foam are first degreased by a soaking step in which the inner boots are agitated for approximately 20 seconds in a solvent bath which has been heated to a boiling temperature. A halogenated solvent is contemplated for use in degreasing the inner boots. Fluorinated and chlorinated solvents are found to be particularly useful for purposes of the present invention. In the case of utilizing a solvent of the fluorinated type it is necessary to heat the solvent to a temperature of about 40° C. If a chlorinated solvent is utilized, it is necessary to heat the solvent to a sufficient temperature to bring the solvent to a vapor phase.

After the first soaking step the inner boot is subjected to a drying step lasting from several seconds to two minutes depending upon whether or not an accelerated drying step is performed, for example in a heated stove, or if the drying step is conducted at ambient or room temperatures.

The process next proceeds to a coating step in which the inner boot is at least partially immersed and soaked, for approximately 10 seconds, in a second bath comprising a mixture of granules of solubilized polyurethane in a heavy solvent mixed with carrier solvents. Preferably the heavy solvent is a dimethylformamide, known commercially as DMF, which can equally be a solution of linear polyurethane (such as a thermal plastic dissolved by a dissolving solvent for the polyurethane; THF, N-Methyl Pyrolidone, or the like). The carrier solvents may be ketonic solvents or aliphatics.

After the coating step, excess coating material is removed from the inner boot during a dripping step which lasts from about 1 minute and 30 seconds to about 2 minutes at ambient or room temperature. After the dripping step, the inner boot is subjected to a drying step in which the inner boot is dried for about 10 minutes at about 70° C. in a ventilated enclosure.

After the drying step, the inner boot is allowed to cool during a cooling step lasting for about two hours at ambient or room temperature. During this cooling step care is taken to avoid all contact between the inner boots which are being treated.

The viscosity of the polyurethane-solvent mixtures utilized in the process of the present invention can vary from 19 centipoise to 24,750 centipoise. This large range of viscosity thus makes it possible to vary the soaking time in order to accommodate foam objects having either opened or closed cell surfaces, which are submerged in this mixture such that one can likewise vary the thickness of the polyurethane coating layer of the soaked object. Of course the viscosities will be adapted to the size of the cells of foam or of the foam objects put into the polyurethane-solvent mixtures such that one may obtain a uniform distribution of the polyurethane coating over the entire surface of the object.

Preferably, for inner boots of ski boots the thickness of the polyurethane coating is on the order of about 10–25 microns. In the above process when the polyurethane film reaches a thickness on the order of about 50 microns, one observes a variation in thickness of the polyurethane film from about 1 to 2 fold. This likewise influences the quantities of materials used and thus the cost of materials to be provided.

Another advantage of the present invention is concerned with of localizing the coating of the mixture of polyurethane to precise zones of the inner boot, for example, all of the lower portion of the inner boot corresponding to the sole of the inner boot. Another advantage of the process of the present invention consists in the fact that there is not, as in a painting process, for example, a chemical transformation of the product after soaking.

When the above coating process is complete, one finds the final product, namely a coating of polyurethane, relatively compact whose density is on the order of 0.9 to 1.3, g/cm$^3$, which is greater than that of the foam inner boot whose density is between 0.3 and 0.5 g/cm$^3$. This final polyurethane coating is securely affixed to the foam inner boot and is uniformly distributed over the treated surface of the inner boot once the solvent is removed.

As discussed in detail above, the ski inner boot of the present invention includes wall portions that define the body of the inner boot wherein at least a lower portion of the booty which surrounds the foot of a skier is at least partially coated by a moisture proof sealing coating. In one preferred embodiment, this sealing coating consists of polyurethane which may be applied to either foam injection molded inner boots or a sewn or stitched inner boots.

In order to assure that the polyurethane coating properly adheres to the walls of the inner boot it is necessary that the wall portions are made from a material that is mechanically compatible for adhesively receiving the polyurethane coating. One material found to be useful in manufacturing the inner boots of the present invention is foam injected polyurethane which has an open cell structure which serves as mechanical means for securing the polyurethane coating. In one particular embodiment, the inner boot walls may be made of a multilayered structure, having an outer most layer made of foam injected polyurethane.

Inasmuch as the polyurethane layer is designed to seal the appropriate portions of the inner boot against moisture or humidity, it in necessary that the polyurethane layer have a closed cell structure. This closed cell structure has a density which is necessarily greater than the open cell foam injected polyurethane from which the inner boot may be made. In one preferred embodiment, the polyurethane coating has a density of about 0.9 to 1.3 g/cm$^3$ and the foam injected polyurethane wall portions of the inner boot have a density of about 0.3 to 0.5 g/cm$^3$.

The thickness of the polyurethane coating should be sufficient to properly seal the inner boot and, at the same time, be sufficiently flexible. In one preferred embodiment, the thickness of polyurethane coating is between about 10 and 25 microns.

One advantage found in the inner boots of the present invention which have a lower portion covered with a sealing layer of polyurethane is that the lower portion of the inner boots are sealed against water or humidity while the upper portion of the inner boots are capable of desorbing water or humidity. This greatly adds to the comfort of the skier.

As discussed in detail above, the process for manufacturing the inner boots of the present invention includes the following sequence of steps:

(a) applying a polyurethane solution to at least a portion of a inner boot;
(b) removing excess polyurethane solution from the inner boot and;
(c) drying the inner boot.

In order to assure that the polyurethane coating will properly adhere to the inner boot, it may be necessary to prepare the surface of the inner boot by degreasing the inner body before applying the polyurethane solution. If degreasing is required, the inner body is degreased by contacting the inner body with a solvent selected from the group consisting of fluorinated solvents and chlorinated solvents.

According to the present invention, if a fluorinated solvent is utilized for degreasing it will be necessary to heat the solvent to a temperature of about 40° C. If a chlorinated solvent is utilized for the degreasing solvent, it will be necessary to heat the solvent so as to bring the solvent to the vapor phase.

The polyurethane coating may be applied by either a soaking process, in which the inner body is immersed in a solution of polyurethane, or by a spraying process.

The polyurethane solution utilized in the present invention is a mixture of soluble polyurethane, a heavy solvent, and carrier solvents. In a preferred embodiment, the heavy solvent used in the polyurethane solution comprises dimethylformamide and the carrier solvents are selected from the group consisting of ketonic solvents and aliphatics.

In manufacturing the inner boots, it is desired to apply a coating of polyurethane which has a thickness between about 10 and 25 microns. In order to control the final thickness of the polyurethane coating, the viscosity of the polyurethane solution is carefully controlled. Moreover, when applying the polyurethane by soaking processes, the soaking time is also controlled in order to achieve proper coating thicknesses.

It has been discovered that the viscosity of the polyurethane solution may be between about 19 and 24,750 centipoise. This wide range of usable viscosities favorably allows coating applications of various time periods, as necessary, to achieve required coating thicknesses.

Prior to the final drying step, excess polyurethane solution is removed by a dripping step. After excess polyurethane solution is removed, the final drying step itself may be an accelerated drying step or a drying step conducted at room or ambient temperature or a combination thereof. Any conventional means may be utilized to provide for an accelerated drying step, such as, for example, an oven or other ventilated enclosure.

Finally, in the ski boot inner boot of the present invention, the advantage of localizing the polyurethane coating on the lower zone of the inner boot makes it possible to have a perfect sealing of the bottom of the foot against water or humidity while preserving a zone at the top of the inner boot for desorbing water or humidity from perspiration.

The present invention is not limited to the products and processes which have just been described, and it is perfectly possible to apply it to objects other than ski boot inner boots whose materials would be compatible with the attachment of such a coating of polyurethane.

Finally, while the invention has been described with reference to particular means, materials and embodiments, it is to be understood that the invention is not limited to the materials disclosed and extends to all equivalents within the scope of the claims.

What is claimed is:

1. An inner boot for a ski boot comprising wall portions that define the body of said inner boot wherein at least a lower portion of said inner boot which surrounds the foot of a skier is at least partially coated by a sealing coating of polyurethane, wherein said wall portions are made from a material that is mechanically compatible for adhesively receiving the polyurethane coating, wherein said wall portions are made from foam injected polyurethane, and wherein said polyurethane coating is of a greater density than the foam injected polyurethane wall portions.

2. An inner boot for a ski boot as in claim 1 wherein the polyurethane coating has a density of about 0.9 to 1.3 g/cm$^3$ and the foam injected polyurethane wall portions have a density of about 0.3 to 0.5 g/cm$^3$.

3. An inner boot for a ski boot as in claim 1 wherein the thickness of the polyurethane coating is between about 10 and 25 microns.

4. A process for manufacturing a ski boot inner boot which comprises:

(a) degreasing an inner boot by soaking said inner boot in a solvent bath;
(b) drying the degreased inner boot;
(c) soaking at least a portion of said inner boot in a polyurethane solution to coat said inner boot with polyurethane;
(d) removing excess polyurethane solution from said inner boot; and
(e) cool drying said inner boot.

5. An inner boot for a ski boot comprising wall portions that define the body of the boot wherein said inner boot has an external surface made from an open cell, foam material, at least a lower portion of which is further coated with a moisture proof sealing layer.

6. An inner boot for a ski boot according to claim 5 wherein the wall portions of said inner boot comprise a multilayer structure.

7. An inner boot for a ski boot according to claim 5 wherein the lower portion of the boot is sealed against water or humidity and wherein an upper portion of the wall is capable of desorbing water or humidity.

8. An inner boot for a ski boot according to claim 5 wherein said inner boot is either a foam injection molded inner boot or a sewn or stitched inner boot.

9. A process for manufacturing a ski boot inner boot which comprises:

(a) applying a polyurethane solution to at least a portion of an inner boot;
(b) removing excess polyurethane solution from said inner boot; and
(c) drying said inner boot.

10. A process for manufacturing a ski boot inner boot according to claim 9 wherein step (a) comprises either a soaking step or a spraying step.

11. A process for manufacturing a ski boot inner boot according to claim 9 wherein said inner boot is degreased prior to step (a).

12. A process for manufacturing a ski boot inner boot according to claim 9 wherein step (c) comprises either an accelerated drying step or a drying step conducted at room or ambient temperature or a combination thereof.

13. A process for manufacturing a ski boot inner boot according to claim 10 wherein the polyurethane solution comprises a mixture of soluble polyurethane, a heavy solvent and carrier solvents.

14. A process for manufacturing a ski boot inner boot according to claim 13 wherein the viscosity of the polyurethane solution is between about 19 and 24,750 centipoise.

15. A process for manufacturing a ski boot inner boot according to claim 13 wherein the heavy solvent comprises a dimethylformamide.

16. A process for manufacturing a ski boot inner boot according to claim 13 wherein the carrier solvents are selected from the group consisting of ketonic solvents and aliphatics.

17. A process for manufacturing a ski boot inner boot according to claim 9 wherein the polyurethane solution of step (a) is of a sufficient viscosity so as to provide for a polyurethane layer of between about 10 and 25 microns.

18. A process for manufacturing a ski boot inner boot according to claim 11 wherein said inner boot is degreased by contacting said inner boot with a solvent selected from the group consisting of fluorinated solvents and chlorinated solvents.

19. A process for manufacturing a ski boot inner boot according to claim 18 wherein the solvent is a fluorinated solvent that is heated to a temperature of about 40° C.

20. A process for manufacturing a ski boot inner boot according to claim 18 wherein the solvent is a chlorinated solvent that is heated so as to be brought to the vapor phase.

21. A process for manufacturing a ski boot inner boot according to claim 10 wherein step (a) comprises a soaking step in which the booty is contacted with a polyurethane soluriton for about 10 seconds.

22. A process for manufacturing a ski boot inner boot according to claim 9 wherein the drying step (c) comprises a dripping step, a room or ambient temperature drying step and an oven drying step.

* * * * *